US005120090A

United States Patent [19]

Reinl

[11] Patent Number: 5,120,090

[45] Date of Patent: Jun. 9, 1992

[54] PRE-DATED GREETING CARD

[76] Inventor: Helene M. Reinl, 121 Indian Hollow Ct., Mahwah, N.J. 07430

[21] Appl. No.: 699,268

[22] Filed: May 13, 1991

[51] Int. Cl.[5] ..... B42D 15/00

[52] U.S. Cl. ..... 283/117; 446/147

[58] Field of Search ..... 446/147, 148, 149; 283/117

[56] References Cited

U.S. PATENT DOCUMENTS 4,484,768 11/1984 Norfleet ..... 446/147

4,931,017 6/1990 Mann ..... 446/147

FOREIGN PATENT DOCUMENTS 2188589 10/1987 United Kingdom ..... 283/117

*Primary Examiner*—Timothy V. Eley

*Assistant Examiner*—Willmon Fridie, Jr.

*Attorney, Agent, or Firm*—Samuelson & Jacob

[57] ABSTRACT

A greeting card for commemorating a particular date includes a front sheet having a obverse face, a reverse face and a pair of laterally spaced apart opposite edges, apertures in the front sheet configured and placed for presenting an image of at least a portion of the date at the obverse face of the front sheet, a back sheet integral with the front sheet along one of the opposite edges of the front sheet and folded along the one of the edges so as to be juxtaposed with the reverse face of the front sheet, and selected areas delineated on the obverse face of the front sheet, adjacent the apertures, for the reception of alphanumeric characters thereon to complete the representation of the date.

8 Claims, 2 Drawing Sheets

PRE-DATED GREETING CARD

The present invention relates generally to greeting cards and pertains, more specifically, to greeting cards designed to commemorate a particular date, such as a birthday, an anniversary or another dated occasion.

While greeting cards have served for a very long time as a popular medium for conveying salutations on dates to be commemorated, the cards themselves seldom display the exact date being commemorated. Although a greeting card bearing an exact date would be quite personal and thus well-received, it is obviously impractical to print greeting cards exhibiting a complete date, by month, day and year, for every day of the year. Greeting cards have been made available with selectively changeable displays so that a sender can tailor the card to a particular occasion; however, even those cards are lacking in the personal touch which would be provided by a greeting card created for just one particular date.

The present invention provides improvements in a greeting card construction which enable the card to serve as a more personalized salutation and, as such, exhibits several objects and advantages, some of which are summarized as follows: Provides a greeting card with a personal touch not available in current greeting cards; enables a greeting card to be modified selectively to serve a desired function so that only a limited number, of greeting cards need be offered for a very large variety of uses; allows the realization of a customized approach to greeting cards not heretofore available in a practical manner.

The above objects and advantages, as well as further objects and advantages, are attained by the present invention which may be described briefly as a greeting card for commemorating a particular date, the greeting card comprising: a front sheet having an obverse face, a reverse face and a pair of laterally spaced apart opposite edges; apertures in the front sheet, the apertures extending from the obverse face to the reverse face and being configured and placed for presenting an image of at least a portion of the date at the obverse face of the front sheet; a back sheet integral with the front sheet along one of the opposite edges of the front sheet and folded along the one of the edges so as to be juxtaposed with the reverse face of the front sheet; and selected areas delineated on the obverse face of the front sheet, adjacent the apertures, for the reception of alphanumeric characters thereon to complete the representation of the date.

The present invention will be understood more fully, while still further objects and advantages will become apparent, in the following detailed description of a preferred embodiment of the invention illustrated in the drawing, in which.

Figure 1:
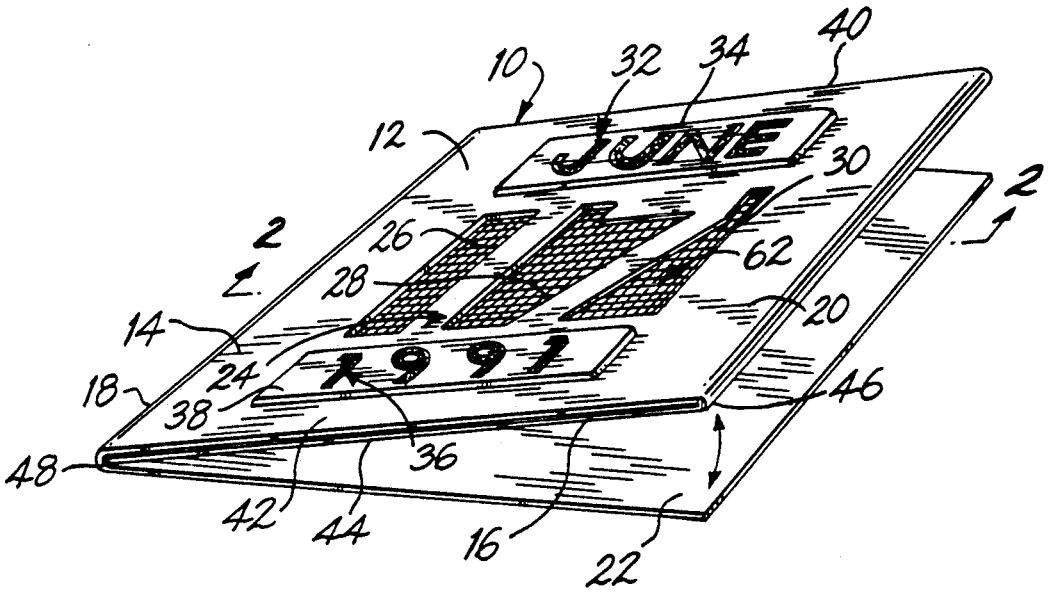
FIG. 1 is a pictorial perspective view of a greeting card constructed in accordance with the present invention.
Figure 2:
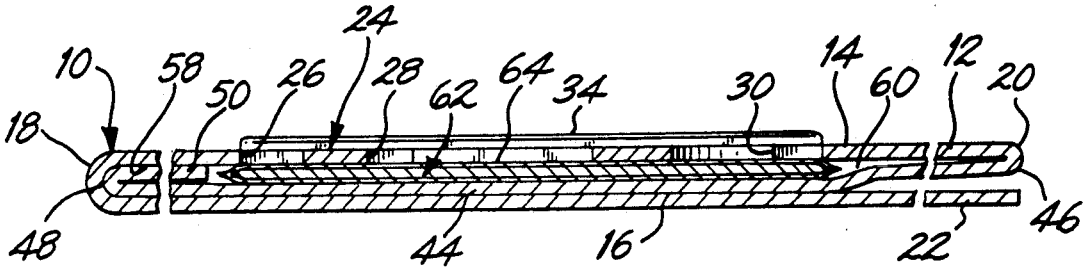
FIG. 2 is an enlarged fragmentary cross-sectional view taken along line 2—2 of FIG. 1, with the greeting card closed.

Referring now to the drawing, and especially to FIGS. 1 and 2 thereof, a greeting card constructed in accordance with the invention is illustrated generally at 10 and is seen to include a front sheet 12 having an obverse face 14, a reverse face 16, and a pair of laterally spaced apart opposite side edges 18 and 20. A back sheet 22 is integral with the front sheet 12, and preferably is unitary therewith, along side edge 18 and is folded along side edge 18 so as to be juxtaposed with the reverse face 16 of the front sheet 12, in a manner well known in the construction of greeting cards.

Greeting card 10 is shown commemorating the particular date "Jun. 17, 1991"as a birthday, anniversary, invitation date or some other occasion or event. The day portion 24 of the date appears at the obverse face 14 of the front sheet 12 in the form of an image presented by apertures 26, 28 and 30 which extend through the front sheet 12, from the obverse face 14 to the reverse face 16, and which are configured to establish the image of the day date "17". The month portion 32 of the date has been inserted within a selected area 34 delineated on the obverse face 14 of the front sheet 12 adjacent the apertures 26, 28 and 30. In the illustrated embodiment, the selected area 34 is delineated by being raised in relief from the obverse face 14. Likewise, the year portion 36 of the date has been inserted within a selected area 38 delineated on the obverse face 14 of the front sheet 12 adjacent the apertures 26, 28 and 30 by being raised in relief from the obverse face 14.

In the described construction of greeting card 10, the greeting card is personalized in that a particular date is presented by the construction of the card itself. In order to render the construction practical, only a portion of the date is fixed in the structure of the card, in this instance the day portion 24, and the remaining portions, in the form of selected month portion 32 and year portion 36, are added by the sender of the card. In this manner, one card 10 can be tailored for any one of twelve dates throughout a single year. The addition of the month portion 32 and the year portion 36 can be accomplished in any one of a variety of ways. For example, stickers bearing alphanumeric characters may be supplied with the card 10 for selective application to the delineated selected areas 34 and 38. In the illustrated embodiment, alphanumeric characters representing the month and year portions 32 and 36 have been written in the respective selected areas 34 and 38. In the preferred arrangement, the selected area 34 is placed between the top edge 40 of the front sheet 12 of greeting card 10 and the apertures 26, 28 and 30, while the selected area 38 is placed between the bottom edge 42 of the front sheet 12 of greeting card 10 and the apertures 26, 28 and 30 so that the apertures 26, 28 and 30 are located intermediate the selected areas 34 and 38.

Figure 3:
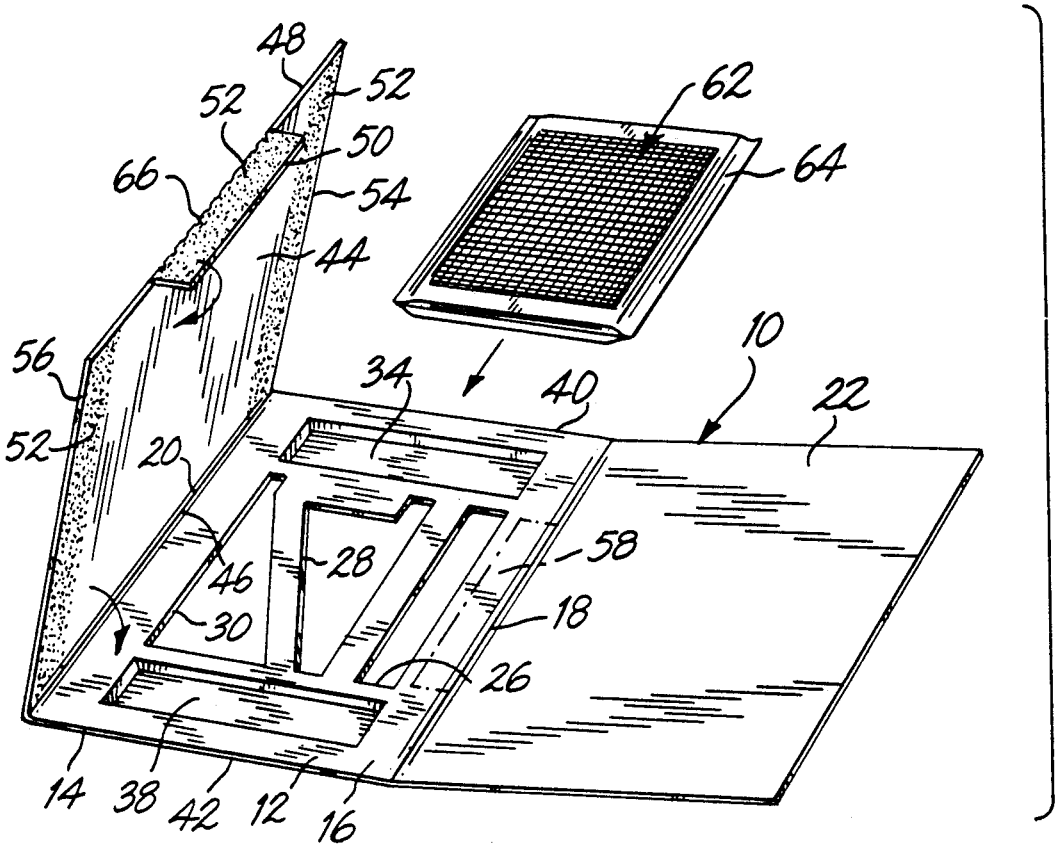
FIG. 3 is a partially diagrammatic perspective view illustrating the construction of the greeting card.
Figure 4:
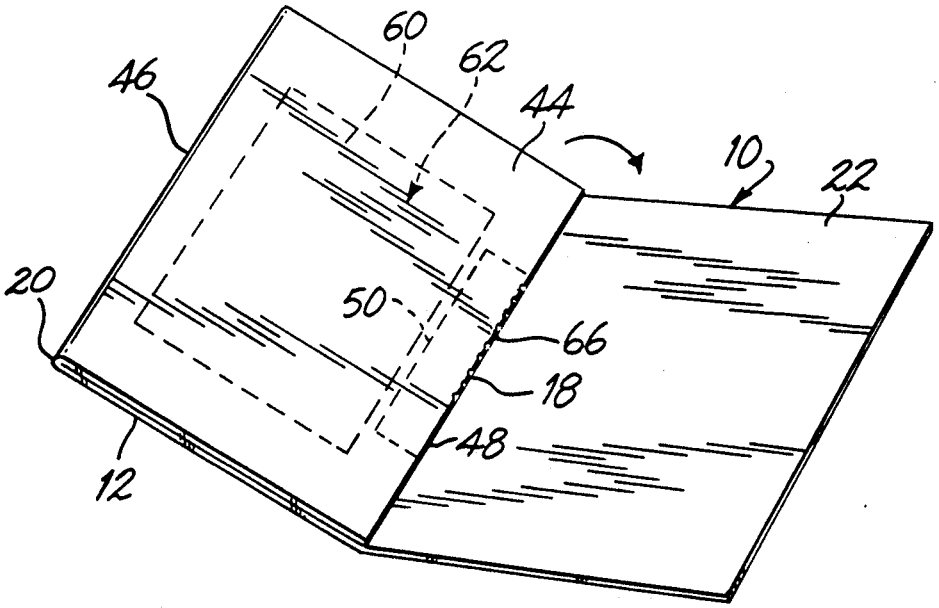
FIG. 4 is a perspective view similar to FIG. 3, but with the component parts of the card in a different position.

As best seen in FIGS. 3 and 4, as well as in FIGS. 1 and 2, greeting card 10 is provided with an intermediate sheet 44 integral with the front sheet 12, and preferably unitary therewith, along side edge 20 and is folded along side edge 20 to lie between the front sheet 12 and the back sheet 22. Intermediate sheet 44 extends between opposite side edges 46 and 48 has an area corresponding generally to the area of the front sheet 12, and the area of the back sheet 22, so as to match the remainder of the greeting card 10. A flap 50 extends from the intermediate sheet 44 along the side edge 48 of the intermediate sheet 44 which corresponds to the side edge 18 of the front sheet 12. The intermediate sheet 44 is affixed to the front sheet 12 by means shown in the form of an adhesive 52 placed along the top edge 54 and the bottom edge 56 of the intermediate sheet 44 to secure the top edges 40 and 54 together and to secure the bottom edges 42 and 56 together. Adhesive 52 also is placed on the flap 50 to secure the flap 50, and the side edge 48 of the intermediate sheet 44, along the side edge 18 of the front sheet 12, at an area shown in phantom at 58 in FIG. 3, thereby establishing a pocket 60 behind apertures 26, 28 and 30, within which pocket 60 is placed an item juxtaposed with and viewable through the apertures 26, 28 and 30 to provide a contrasting background highlighting the image of the day portion 24 of the date at the obverse face 14 of the front sheet 12.

In the illustrated embodiment, the item placed in the pocket 60 is a packet 62 of scented material, such as potpourri, having an outer envelope 64 of porous material of a color contrasting the color of the obverse face 14 of the front sheet 12. Thus, the packet 62 provides greeting card 10 with a pleasant aroma as well as an aesthetically appealing appearance. The aroma is dispersed through the apertures 26, 28 and 30 to the ambient atmosphere. A perforated cut line 66 is provided along the boundary between the flap 50 and the intermediate sheet 44, along side edge 48 of the intermediate sheet 44, to facilitate the selective opening of the pocket 60 for the release of the packet 62 for use by the recipient of the greeting card 10 independent of the card itself. The greeting card 10 may be packaged for sale in a sealed, thin film packaging material (not shown), as is conventional in packaging items for placement at a point of purchase, in order to seal in the scented material until the greeting card 10 is put into actual use.

It will be seen that the present invention provides improvements in a greeting card construction which enable the card to serve as a more personalized salutation and, as such exhibits the several objects and advantages outlined above, as follows: Provides a greeting card with a personal touch not available in current greeting cards; enables a greeting card to be modified selectively to serve a desired function so that only a limited number of greeting cards need be offered for a very large variety of uses; allows the realization of a customized approach to greeting cards not heretofore available in a practical manner.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A greeting card for commemorating a particular date, the greeting card comprising:

a front sheet having an obverse face, a reverse face and a pair of laterally spaced apart opposite edges;

apertures in the front sheet, the apertures extending from the obverse face to the reverse face and being configured and placed for presenting an image of at least a portion of the date at the obverse face of the front sheet;

a back sheet integral with the front sheet along one of the opposite edges of the front sheet and folded along the one of the edges so as to be juxtaposed with the reverse face of the front sheet; and selected areas delineated on the obverse face of the front sheet, adjacent the apertures, for the reception of alphanumeric characters thereon to complete the representation of the date.

2. The invention of claim 1 wherein the apertures are located intermediate the selected areas and are configured to present an image of a number representing a day of a month.

3. The invention of claim 2 wherein the opposite edges are side edges and the front sheet includes longitudinally opposite top and bottom edges, the selected areas being located such that at least one of the selected areas is between the top edge and the apertures and another of the selected areas is between the bottom edge and the apertures.

4. The invention of claim 1 wherein the selected areas are raised in relief from the obverse face.

5. The invention of claim 1 including:

an intermediate sheet integral with the front sheet along the other of the opposite edges and folded along said other of the opposite edges to lie between the front sheet and the back sheet; and means affixing the intermediate sheet to the front sheet to establish a pocket placed behind the apertures for the retention of an item in the pocket, juxtaposed with the apertures.

6. The invention of claim 5 wherein the item retained in the pocket is a scented packet.

7. The invention of claim 5 wherein the means affixing the intermediate sheet to the front sheet includes a flap on the intermediate sheet affixed to the front sheet adjacent said one of the opposite edges, and a cut line between the flap and the intermediate sheet for enabling the flap to be cut selectively from the intermediate sheet to open the pocket and release the item.

8. The invention of claim 7 wherein the item retained in the pocket is a scented packet selectively released from the pocket.

* * * * *